US005988207A

United States Patent [19]

Kownacki et al.

[11] Patent Number: 5,988,207

[45] Date of Patent: Nov. 23, 1999

[54] DECORATIVE STORAGE DEVICE FOR GARDEN HOSE

[75] Inventors: Charles D. Kownacki, Erie; Franklin T. Clark, Jr., Girard; Stephen M. Oas; John C. Ramsey, both of Erie, all of Pa.

[73] Assignee: EMSCO, Inc., Girard, Pa.

[21] Appl. No.: 09/100,899

[22] Filed: Jun. 19, 1998

[51] Int. Cl.[6] ..... B65H 75/34

[52] U.S. Cl. ..... 137/355.27; 137/355.28; 248/79

[58] Field of Search ..... 137/355.26, 355.27, 137/355.28; 248/79, 88

[56] References Cited

U.S. PATENT DOCUMENTS 4,520,872 6/1985 Holman ..... 137/355.27 X 5,404,900 4/1995 Fletcholl ..... 137/355.27

*Primary Examiner*—John Fox

*Attorney, Agent, or Firm*—Richard K. Thomson

[57] ABSTRACT

A hose storage device has a tub shaped base and a hemispherical top that is attached to the base by a clamshell hinge. The storage device can be anchored in place in a yard by U-shaped stakes that are inserted through pairs of openings. The storage device is decorated to appear like a fanciful character statue, a galapagos tortoise, for example, so that it can remain in the yard as a lawn or garden decoration. A center post in the tub provides a bearing surface for a reel which includes a handle to facilitate coiling and fixtures to which the hose can be connected so that it need never be removed from the reel. A downwardly extending nipple provides a place to connect a short length of hose to a spigot, a clearance passageway being afforded by an inwardly extending reinforcing rib in the tub.

18 Claims, 4 Drawing Sheets

DECORATIVE STORAGE DEVICE FOR GARDEN HOSE

The present invention is directed to a device for storing a garden hose. More particularly, the present invention is directed to a storage container that has a decorative exterior which may be left in the yard as a lawn or garden ornament.

BACKGROUND AND SUMMARY OF THE INVENTION

Various devices have been proposed for coiling and storing garden hoses. By and large, what you have when you are finished is an unsightly tangle that hangs on the side of the house or can be hidden away in a shed or garage.

It is an object of this invention to provide a storage device that can also serve as a decorative accessory for lawn or garden. The storage device of the present invention comprises a bottom portion that receives the garden hose, a top portion that is connected to the bottom portion by a clam shell hinge to provide access to the hose. The top portion is preferably a fanciful character, for example, a galapagos tortoise, so that the storage device can be left out in the yard as a decoration. A center post defines a recess into which the garden hose can be stored by coiling or, in one embodiment, serves as a mount for a reel upon which the garden hose can be wound.

In the deluxe model employing the reel, a short section of hose is attached to a female rotary fitting extending downwardly inside the center post and a male rotary fitting extends through a slot in the side of the reel and provides an attachment point for the stored garden hose. The upper male fitting can rotate relative to the lower female fitting to permit the reel and the upper mail fitting to be rotated to coil the hose onto the reel. The upper male fitting is sealed relative to the lower stationary female fitting by a pair of O-rings to prevent leakage between the relatively rotating members. Four tortoise feet can be attached to the bottom portion to enhance the tortoise-like appearance and four U-shaped anchor pins can be hammered through the bottom portion into the ground to keep the storage container in place. This storage device is available from EMSCO Inc., Girard, Pa., assignee of the present invention and is being marketed as HOSE HIDERS™ hose reel/lawn storage system. This particular tortoise design is marketed as DARWIN™ galapagos tortoise.

Various other features, advantages and characteristics of the present invention will become apparent to a person of ordinary skill in the art after a reading of the following description of the invention.

BRIEF DESCRIPTION OF THE DRAWINGS

The preferred embodiments of the present invention are described in conjunction with the following figures, like items bearing like reference numerals and in which.

DETAILED DESCRIPTION OF THE PREFERRED EMBODIMENTS

Figure 1:
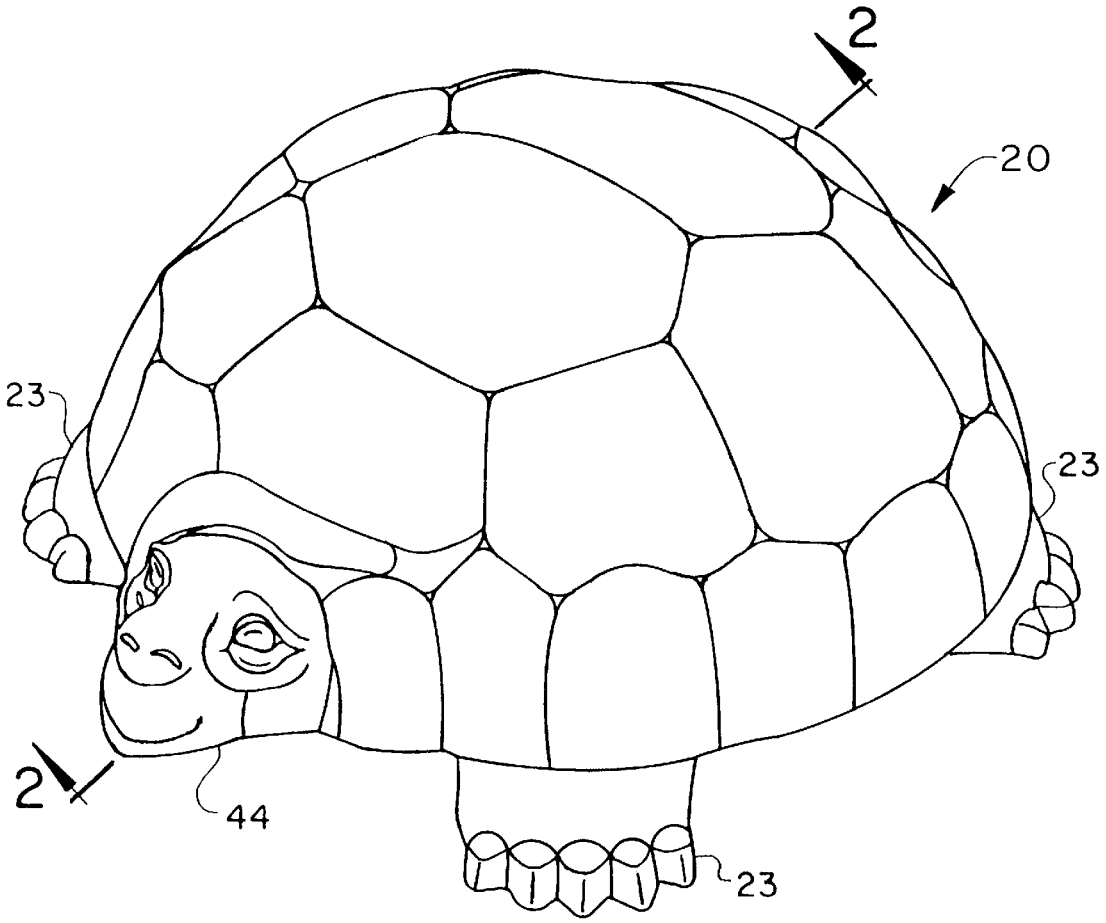
FIG. 1 is a perspective view of a first embodiment of the hose storage device of present invention.
Figure 2:
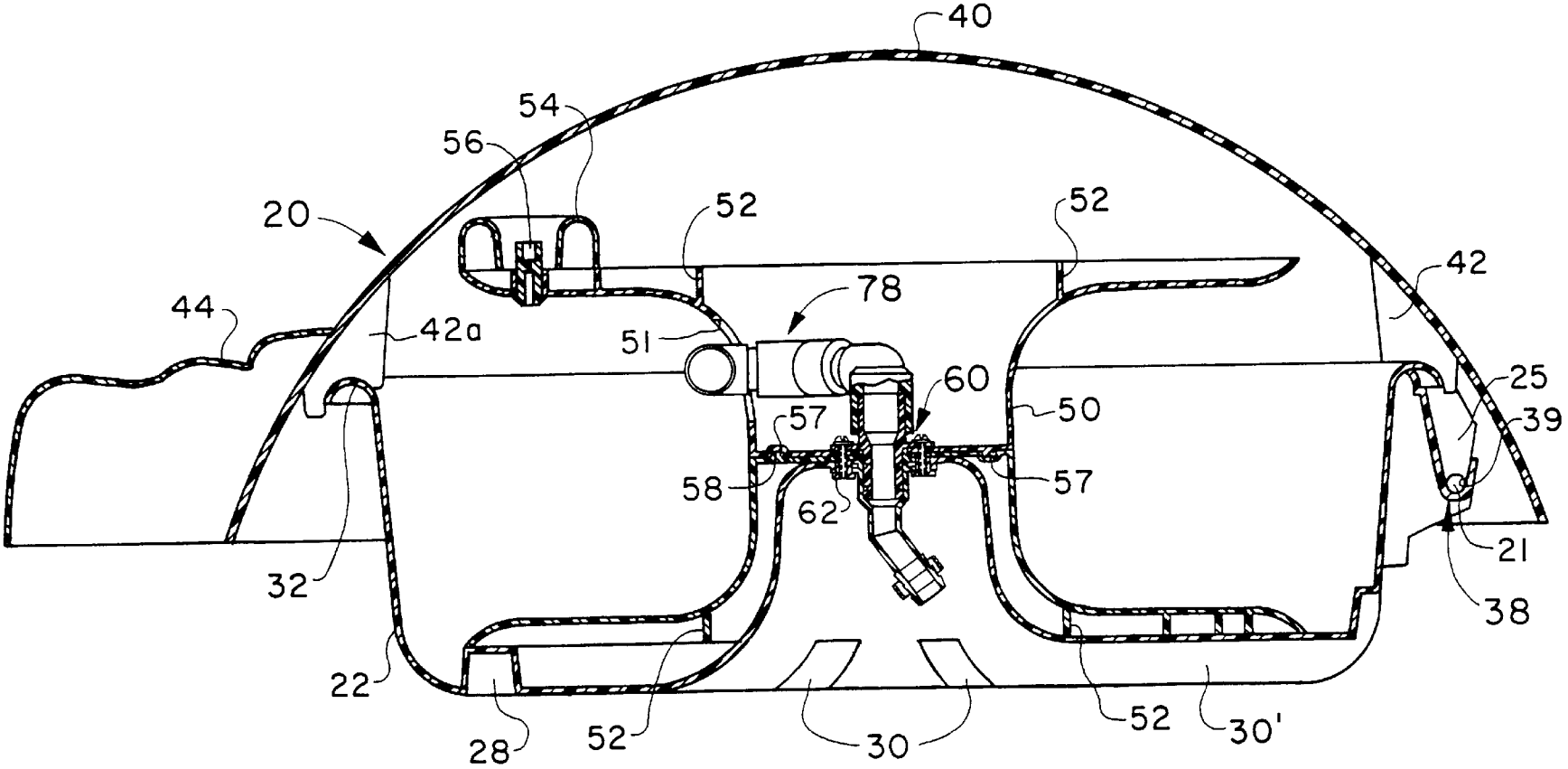
FIG. 2 is a cross-sectional side view taken along line 2—2 in FIG. 1.
Figure 3:
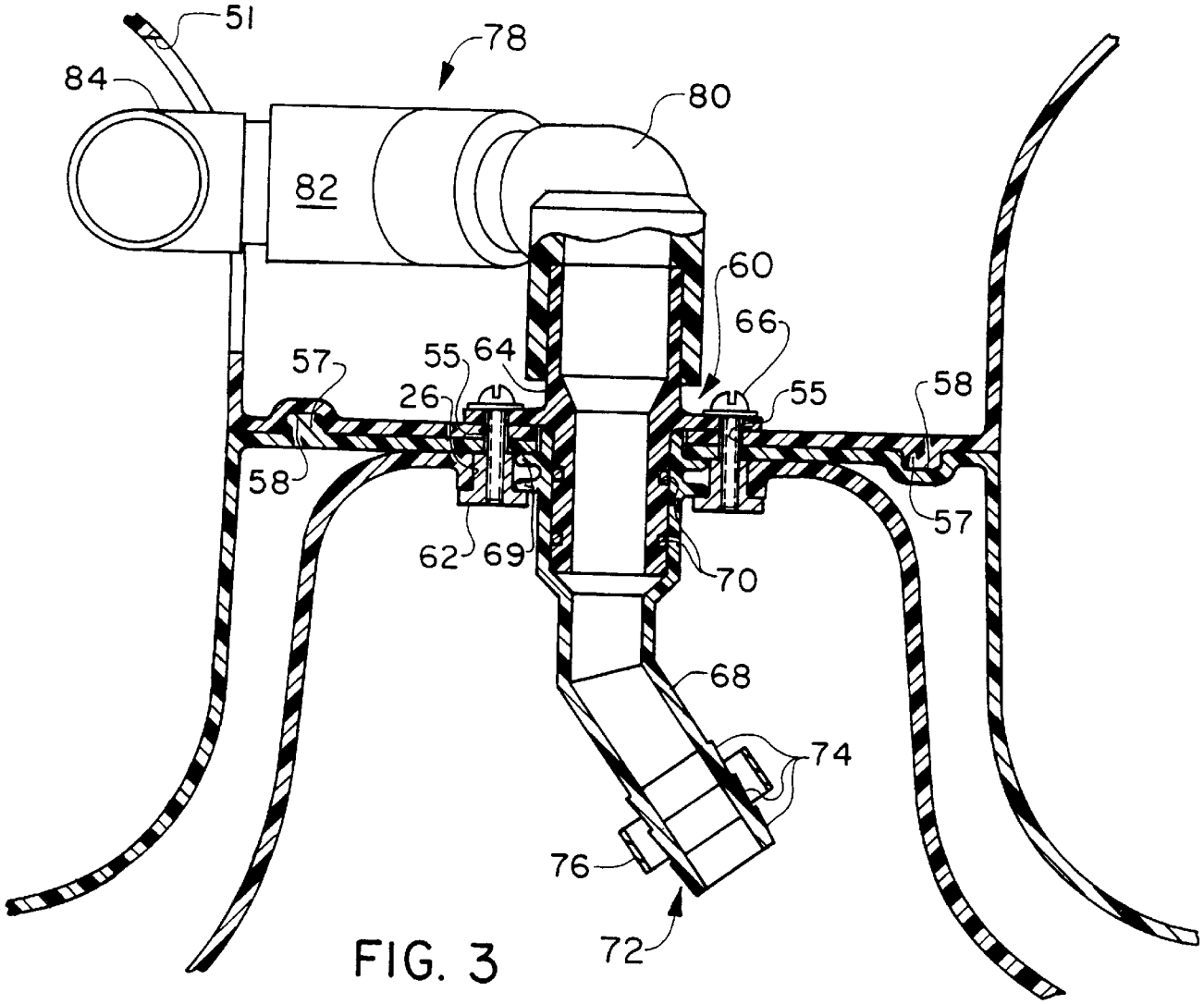
FIG. 3 is an enlargement of a portion of the FIG. 2 embodiment showing certain details of the reel with the hose connection.
Figure 6:
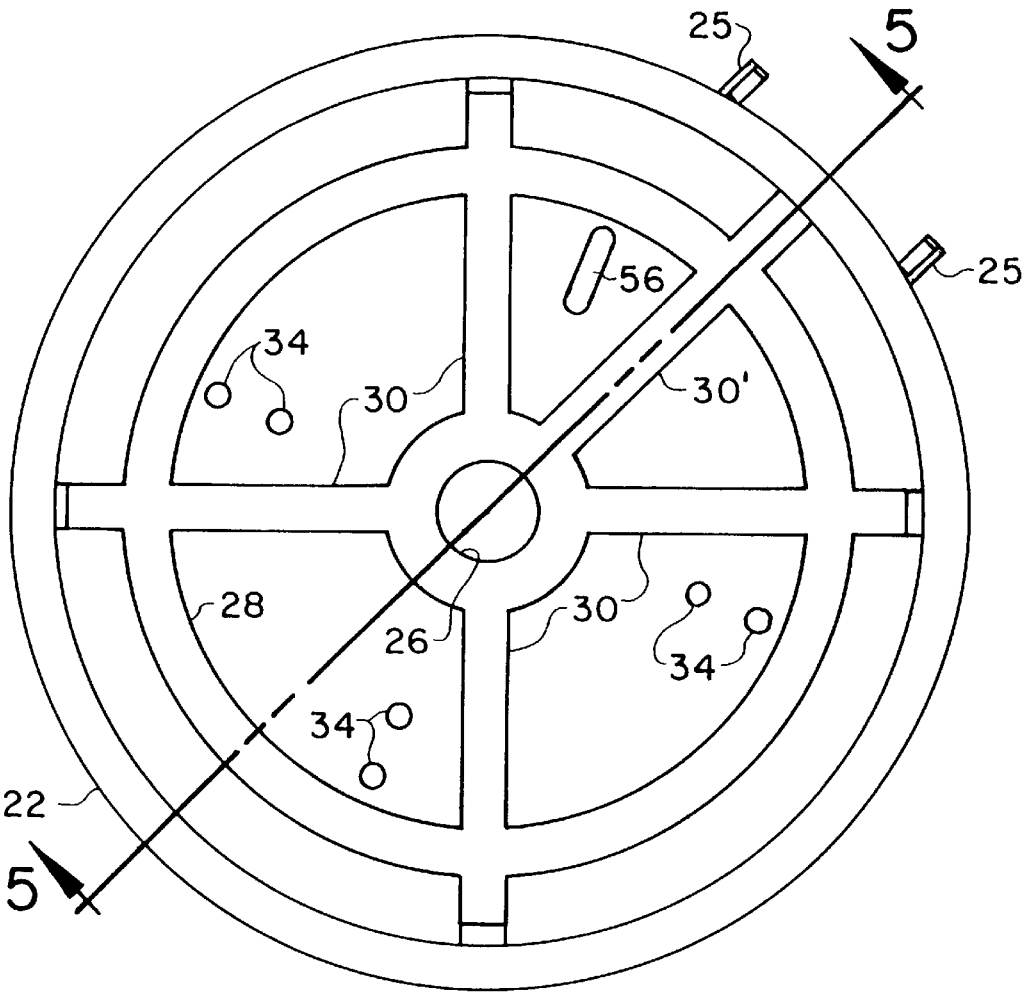
FIG. 6 is a top view of the bottom portion of the FIG. 5 embodiment.

The hose storage device of the present invention is shown in FIGS. 1 and 2 generally at 20. A cover or top portion 40 is attached to a base tub or bottom portion 22 by a clam shell hinge 38. Pivot axles 21 attached to the top are snapped into openings 39 on base hinge members 25. Top or shell portion 40 is molded as a hemispherical dome and decorated to look like, for example, a tortoise shell. Other fanciful characters could be substituted, however, such as a frog or ornamental stone, statue, or the like. The details of bottom portion 22 for the FIG. 1–4 embodiment are identical to the second embodiment shown in FIGS. 5 and 6 except that the reel 50 and its associated connecting hardware 60 is not included in the second embodiment. Therefore, bottom portion 22 will be described making reference to FIGS. 5 and 6.

Bottom portion 22 is generally tub shaped with a center post 24 extending upwardly from the center of the tub 22. In the second embodiment, the hose is brought up through opening 26 in center post 24 and coiled into the bottom portion 22 around center post 24. In the FIG. 1–3 embodiment, center post 24 serves as a support for reel 50. Tub-shaped bottom portion 22 has a lattice of annular (28) and linear (30) reinforcing ribs to provide the otherwise thin plastic sheeting material, from which it is made, some structural stability. An additional rib 30' extends toward the tail of the tortoise and provides a clearance passageway for the garden hose to underlie the bottom portion 22 without being pinched. Actually, any of the linear ribs 30 could be used to provide the clearance passageway. In addition to ribs 28 and 30 providing structural stability, the upper edge 32 is rolled over to give the tub 22 additional strength. In the lower regions of the bottom portion 22, pairs of holes 34 are formed to accommodate a plurality of stakes 56. As shown in the drawing, pairs of holes 34 are formed in each quadrant of the tub 22 so four stakes are used. Other numbers, of course, may alternatively be used. A U-shaped stake 56 is received in each of the pairs of holes 34 to provide the desired retention force that holds the storage device 20 in place. Four identical feet 23 are secured to bottom portion 22 by snapping a rib on the foot (not shown) into a slot in bottom portion 22 to enhance the tortoise-like appearance (FIG. 1).

Top portion 40 is made of rigid molded plastic that preferably has a blue-green pigment and gives an appearance of burnished bronze. A plurality of ribs 42 are molded on the interior of the shell portion 40 and engage over rolled edge 32 to maintain proper relationship between top portion 40 and bottom portion 22. The front rib 42*a* may have an interference fit with edge 32 to prevent the top portion 40 from being lifted by the wind. A tortoise head 44 is molded integrally with shell portion 40 (although it could be made separate and attached as the feet are). Clam shell hinge 38 keeps top portion 40 together with bottom portion 22 while permitting it to be rotated upwardly through 90°+ to provide access to the tub 22 to insert or remove the garden hose (not shown). Shell 40 has a pattern formed on its exterior that mimics the pattern on the shell of a galapagos tortoise.

Reel 50 has a conventional shape with reinforcing ribs 52 added to make it more sturdy. A rotatable handle 54 is attached to an upper outer edge portion by a pop-in fastener 56 that will permit rotation. Accordingly, the handle 54 can be grasped and the reel 50 rotated to coil the hose thereon.

Reel 50 is preferably made of two identical halves that having mating protrusions 57 and recesses 58 to properly position the two halves. Connecting hardware 60 includes capture ring 62 that seats in opening 26 and functions as a bearing means permitting reel 50 and its associated hardware to rotate relative to center post 24. Upper male member 64 is fastened through holes 55 in reel 50 to capture ring 62 by four screws 66 (two shown). Capture ring 62 captures flanges 69 of lower female member 68 and a pair of O-rings 70 provide a seal between upper rotating member 64 and stationary lower member 68. Capture ring 62 is of such a height as to provide a standoff region so that flanges 69 of lower member 68 are loosely held so that lower member 68 is free to remain stationary as the reel 50 and its attached hardware is rotated. A short section of garden hose (not shown) is attached to lower end 72 of lower member 68. The resilient hose is pushed as far on the series of annular protrusions 74 as possible and then secured by a conventional hose clamp 76. This short section of hose will be used to secure the HOSE HIDERS™ storage device to an exterior household spigot.

Figure 4:
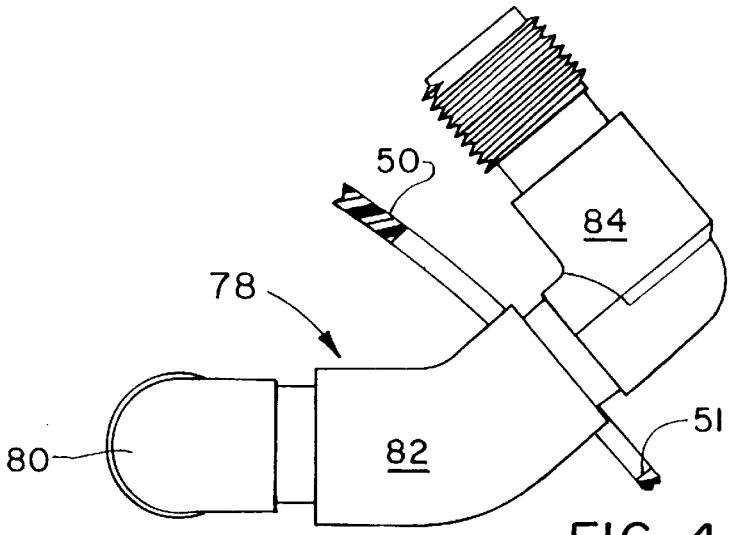
FIG. 4 is a top view of the plumbing connection that extends through the reel of the first embodiment.
Figure 5:
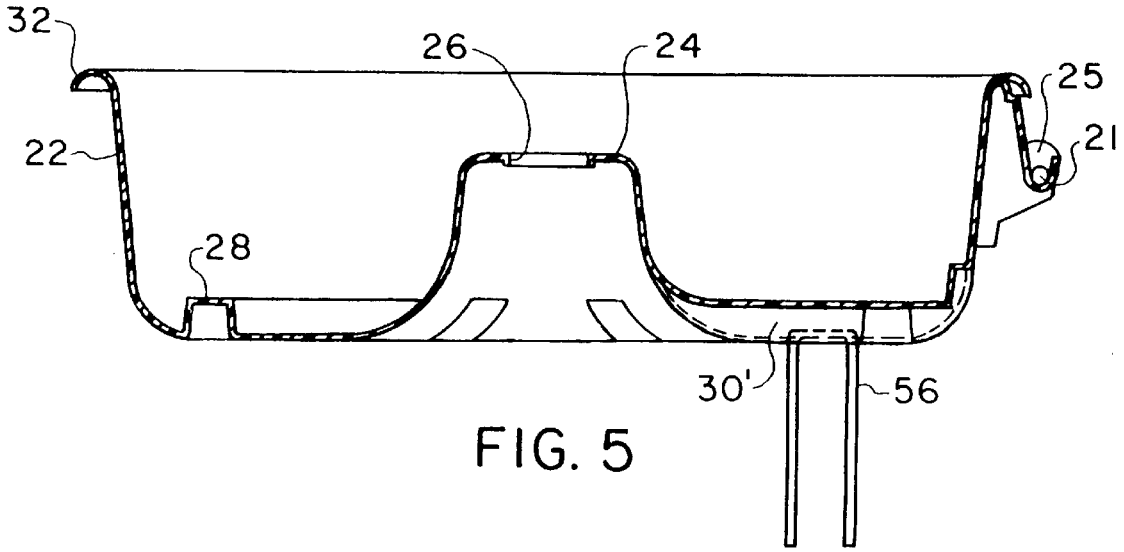
FIG. 5 is a cross-sectional side view of a second embodiment of the present invention taken along line 5—5 in FIG. 6.

Commercially available fittings 78 redirect the water flow through a first 90° elbow from vertical to horizontal at 80, through a 45° elbow 82, and then through a second 90° elbow 84 that extends through an opening 51 in reel 50 (see FIG. 4). Elbow 84 has a threaded end that extends generally around the reel 50 to which the garden hose to be stored (not shown) can be attached. The female end of the hose is connected to elbow 84 and the reel 50 rotated in a direction away from the right angle of elbow 84, that is, in a clockwise direction as viewed from above reel 50.

The storage device 20 of the present invention is both functional and decorative. The short section of hose is connected to the spigot and to the end 72 of female member 68. The stored garden hose is connected to elbow 84 and need never be removed therefrom. Top portion 40 can be rotated to an open position on clamshell hinge 38 to permit the hose to be uncoiled and used. When the watering job is complete, the hose is recoiled onto reel 50 by grasping handle 54. When the top portion is rotated downwardly on hinge 38 to overlie the bottom portion 22 and the stored hose, the rib 42*a* in effect, clips the lid shut, as a result of its interference fit with rolled edge 32. The HOSE HIDERS™ hose reel/lawn storage system then functions as a lawn or garden decoration, having an appearance of a bronze statue.

Various changes, alternatives and modifications will become apparent to a person of ordinary skill in the art after a reading of the foregoing specification. It is intended that all such changes, alternatives and modifications as come within the scope of the appended claims be considered part of the present invention.

We claim:

1. A device for storing a garden hose comprising:

a) a bottom portion for receiving said garden hose;

b) a top portion for overlying and concealing said garden hose and at least partially overlying said bottom portion;

c) a clam-shell hinge connecting said top portion to said bottom portion and permitting said top portion to pivot upwardly from a closed position to an open position providing access to the garden hose.

2. The device of claim 1 wherein said top portion comprises a decorative element whereby said device for storing the garden hose can remain in a yard as an attractive accessory.

3. The device of claim 2 wherein said decorative element comprises a fanciful character.

4. The device of claim 3 wherein said character comprises a galapagos tortoise.

5. The device of claim 4 further comprising four feet attached to said bottom portion.

6. The device of claim 3 wherein said device is made of a rigid plastic.

7. The device of claim 6 wherein said plastic is colorized to look like burnished bronze.

8. The device of claim 1, said bottom portion further comprising a center post about which said garden hose can be coiled.

9. The device of claim 8 further comprising a storage reel for receiving said garden hose, said storage reel being rotatably mounted on said center post.

10. The device of claim 9 wherein said storage reel further comprises means to coil said garden hose onto said reel.

11. The device of claim 10 wherein said means to coil comprises bearing means for said reel and a rotatable hand crank to facilitate retrieval of said hose onto said reel.

12. The device of claim 11 wherein said bearing means comprises a capture ring seated under an upper portion of said center post which is attached to said reel positioned above said center post.

13. The device of claim 12 further comprising a threaded attachment including a stationary lower female member mounted within said capture ring and an upper male member extending out through an opening in a laterally extending portion of said reel.

14. The device of claim 13 further comprising a threaded fixture to which the hose is attached, said fixture extending laterally through a generally vertical portion of a reel wall.

15. The device of claim 12 wherein said upper male member is mounted to rotate relative to said stationary lower female member in conjunction with said reel, seal means positioned between said relatively rotatable members to minimize leakage therebetween.

16. The device of claim 15 further including a short length of hose interconnecting said storage device with a source of water such as a tap.

17. The device of claim 1 further comprising anchoring means to secure said device to a ground section beneath said device.

18. The device of claim 1 further comprising clearance space beneath said lower portion through which a hose portion can pass without being pinched.

* * * * *